US008469152B2

(12) United States Patent
Olsen et al.

(10) Patent No.: US 8,469,152 B2
(45) Date of Patent: Jun. 25, 2013

(54) METHODS AND SYSTEMS FOR MULTI-CAPACITY VEHICLE LIFT SYSTEM

(75) Inventors: Michael Alf Olsen, Lake Saint Louis, MO (US); Michael David Gerdes, St. Peters, MO (US); Peter N. Liebetreu, University City, MO (US)

(73) Assignee: Hunter Engineering Company, St. Louis, MO (US)

( * ) Notice: Subject to any disclaimer, the term of this patent is extended or adjusted under 35 U.S.C. 154(b) by 976 days.

(21) Appl. No.: 12/198,260

(22) Filed: Aug. 26, 2008

(65) Prior Publication Data

US 2009/0078509 A1 Mar. 26, 2009

Related U.S. Application Data

(60) Provisional application No. 60/974,964, filed on Sep. 25, 2007.

(51) Int. Cl.
*B66B 9/04* (2006.01)

(52) U.S. Cl.
USPC ..... 187/211; 187/275; 414/800

(58) Field of Classification Search
USPC ..... 187/269, 211, 270, 275; 254/122, 254/12; 108/144.11, 145, 147; 182/69.5, 182/69.1; 414/800
See application file for complete search history.

(56) References Cited

U.S. PATENT DOCUMENTS

| | | | | |
|---|---|---|---|---|
| 2,001,744 A | | 5/1935 | Patterson | |
| 2,070,960 A | | 2/1937 | Phillips | |
| 2,610,824 A | | 9/1952 | Grier | |
| 3,032,319 A | * | 5/1962 | Ingvald | 254/122 |
| 3,110,476 A | * | 11/1963 | Farris | 254/122 |
| 3,174,722 A | | 3/1965 | Alm | |
| 3,282,566 A | * | 11/1966 | Clarke | 254/122 |
| 3,379,411 A | | 4/1968 | Vanderjagt | |
| 3,982,718 A | * | 9/1976 | Folkenroth et al. | 248/421 |
| 4,221,280 A | * | 9/1980 | Richards | 187/269 |
| 4,403,680 A | * | 9/1983 | Hillesheimer | 177/146 |
| 4,526,346 A | * | 7/1985 | Galloway et al. | 254/122 |
| 4,682,750 A | * | 7/1987 | Rudolph et al. | 108/145 |
| 4,688,760 A | | 8/1987 | Garman et al. | |
| 4,690,250 A | * | 9/1987 | Bergstrom | 187/207 |
| 4,754,713 A | * | 7/1988 | Chatenay epouse Compagnone | 100/144 |
| 4,764,075 A | | 8/1988 | Cox et al. | |
| 4,858,888 A | | 8/1989 | Cruz et al. | |
| 4,890,692 A | * | 1/1990 | Oakman | 182/141 |

(Continued)

FOREIGN PATENT DOCUMENTS

| | | |
|---|---|---|
| DE | 3801491 A1 | 8/1989 |
| DE | 29920934 U1 | 3/2000 |

(Continued)

OTHER PUBLICATIONS

An English language Abstract of Foreign Reference DE 3801491 (1 page).

*Primary Examiner* — William E Dondero
*Assistant Examiner* — Michael Riegelman
(74) *Attorney, Agent, or Firm* — Armstrong Teasdale LLP

(57) ABSTRACT

Methods and systems for a multi-capacity vehicle lift system are provided. The system includes a lift assembly having a plurality of lift capacities and a load platform coupled to the lift assembly. The load platform includes a plurality of lift starting positions, each of the plurality of lift starting positions corresponding to a respective one of the plurality of lift capacities.

18 Claims, 6 Drawing Sheets

U.S. PATENT DOCUMENTS

| | | | | |
|---|---|---|---|---|
| 4,899,987 | A * | 2/1990 | Craig | 254/122 |
| 4,921,074 | A | 5/1990 | Ochs | |
| 5,192,053 | A * | 3/1993 | Sehlstedt | 254/122 |
| 5,299,906 | A | 4/1994 | Stone | |
| 5,322,143 | A * | 6/1994 | Curran | 187/211 |
| 5,460,460 | A * | 10/1995 | Alexander | 14/71.3 |
| 5,829,948 | A * | 11/1998 | Becklund | 414/607 |
| 6,182,796 | B1 * | 2/2001 | Perlstein et al. | 187/208 |
| 6,464,205 | B2 * | 10/2002 | Wanner | 254/122 |
| 6,601,826 | B1 * | 8/2003 | Granata | 254/122 |
| 6,672,430 | B2 * | 1/2004 | Boucher et al. | 187/269 |
| 6,814,188 | B1 * | 11/2004 | Heckert | 187/269 |
| 7,213,686 | B2 * | 5/2007 | Kaufman | 187/262 |
| 2006/0126966 | A1 | 6/2006 | Strege et al. | |
| 2006/0279728 | A1 | 12/2006 | Dorrance et al. | |
| 2007/0017748 | A1 * | 1/2007 | Heckert et al. | 187/211 |
| 2007/0235266 | A1 * | 10/2007 | Dantas et al. | 187/269 |

FOREIGN PATENT DOCUMENTS

| | | | |
|---|---|---|---|
| DE | 202004013362 | U1 | 12/2004 |
| FR | 1282755 | | 1/1962 |
| FR | 1473991 | | 3/1967 |
| GB | 2267695 | A | 12/1993 |
| WO | 0127499 | A1 | 4/2001 |

* cited by examiner

METHODS AND SYSTEMS FOR MULTI-CAPACITY VEHICLE LIFT SYSTEM

CROSS REFERENCE TO RELATED APPLICATIONS

This application claims priority to and the benefit of the filing date of U.S. Provisional Application No. 60/974,964 filed on Sep. 25, 2007, entitled "Methods and Systems for Multi-capacity Vehicle Lift System," which is hereby incorporated by reference in its entirety.

BACKGROUND

This invention relates generally to lift systems, and more particularly to methods and systems for vehicle lift systems having two or more lifting capacities.

At least some known above grade vehicle lift systems, especially those designed for lifting vehicles to a maintenance height, include a pair of runway tracks for positioning the vehicle, a base member for supporting the vehicle and vehicle lift system, and an expandable linkage system usually powered by a hydraulic cylinder or lead screw driving member to provide a lifting force. A ramp leading to each of the runway tracks permits a vehicle to be driven onto the vehicle lift system prior to being lifted. A height of the vehicle lift system and the vehicle ground clearance generally determines the configuration of the ramp. In general it is desirable to have the lowered height of the vehicle lift system be as low as possible. A low lowered height permits vehicles with a lower ground clearance to be driven onto the vehicle lift system without having to use long approach ramps. A higher height vehicle lift system or a vehicle with a low ground clearance requires a longer less sloped ramp. A vehicle lift system configured to a relatively low height may be limited in lifting capacity, however due to the size limitations and orientation imposed on the actuating mechanism by the low height.

If a greater lifting capacity is needed, the lowered height of the vehicle lift system typically becomes greater. This increased height requires longer approach ramps. However, the dimensions of a garage or shop may preclude a long ramp approach to the vehicle lift system. Therefore, space limitations may effectively place a limitation on the practical height of the vehicle lift system in the fully lowered position.

Generally, the actuating mechanism and the expandable linkage system are located within the space defined by the runway and the base. Positioning the actuating mechanism and the expandable linkage system outside of this space tends to inhibit access of the technician to the area under the vehicle to be worked on.

A vehicle lift system having an actuating mechanism that is sized and positioned to accommodate such limitations may be of sufficient capacity to be able to lift relatively smaller vehicles, however, to increase the vehicle lift system efficiency, larger vehicles should be accommodated as well.

It is desired to have a vehicle lifting system that has both a low lowered height as well as a high lifting capacity.

SUMMARY

In one embodiment, a multi-capacity vehicle lift system includes a lift assembly having a plurality of lift capacities and a load platform coupled to the lift assembly. The load platform includes a plurality of lift starting positions, each of the plurality of lift starting positions corresponding to a respective one of the plurality of lift capacities.

In another embodiment, a method of increasing the lift capacity of a lift device is provided. The lift device includes an expandable linkage coupled to a load platform, the expandable linkage includes an actuator coupled to the expandable linkage and provides a force to the expandable linkage. The method includes selecting a first starting position from a plurality of available starting positions for the actuator wherein each of the available starting positions corresponds to one of a plurality of lifting capacities and positioning the actuator in the selected first starting position wherein the expandable linkage is in a first collapsed position.

In yet another embodiment, a lifting device for a vehicle includes a first and second scissor units, each of which includes a base member and a load platform and for each scissor unit, a respective driving member assembly pivotally attached to a lever of the respective scissor unit, the driving member configured to be translated between a first starting position and a second starting position while the scissor units are in an initial collapsed position.

DETAILED DESCRIPTION

The following detailed description illustrates the disclosure by way of example and not by way of limitation. The description clearly enables one skilled in the art to make and use the disclosure, describes several embodiments, adaptations, variations, alternatives, and uses of the disclosure, including what is presently believed to be the best mode of carrying out the disclosure. The disclosure is described as applied to a preferred embodiment, namely, systems and methods for increasing the lift capacity of a lifting device. However, it is contemplated that this disclosure has general application to vehicle lift systems, jacks, positioners, and other machines that provide an application of force in vertical, horizontal, and a combination of orientations in industrial, commercial, and residential applications.

Figure 1:
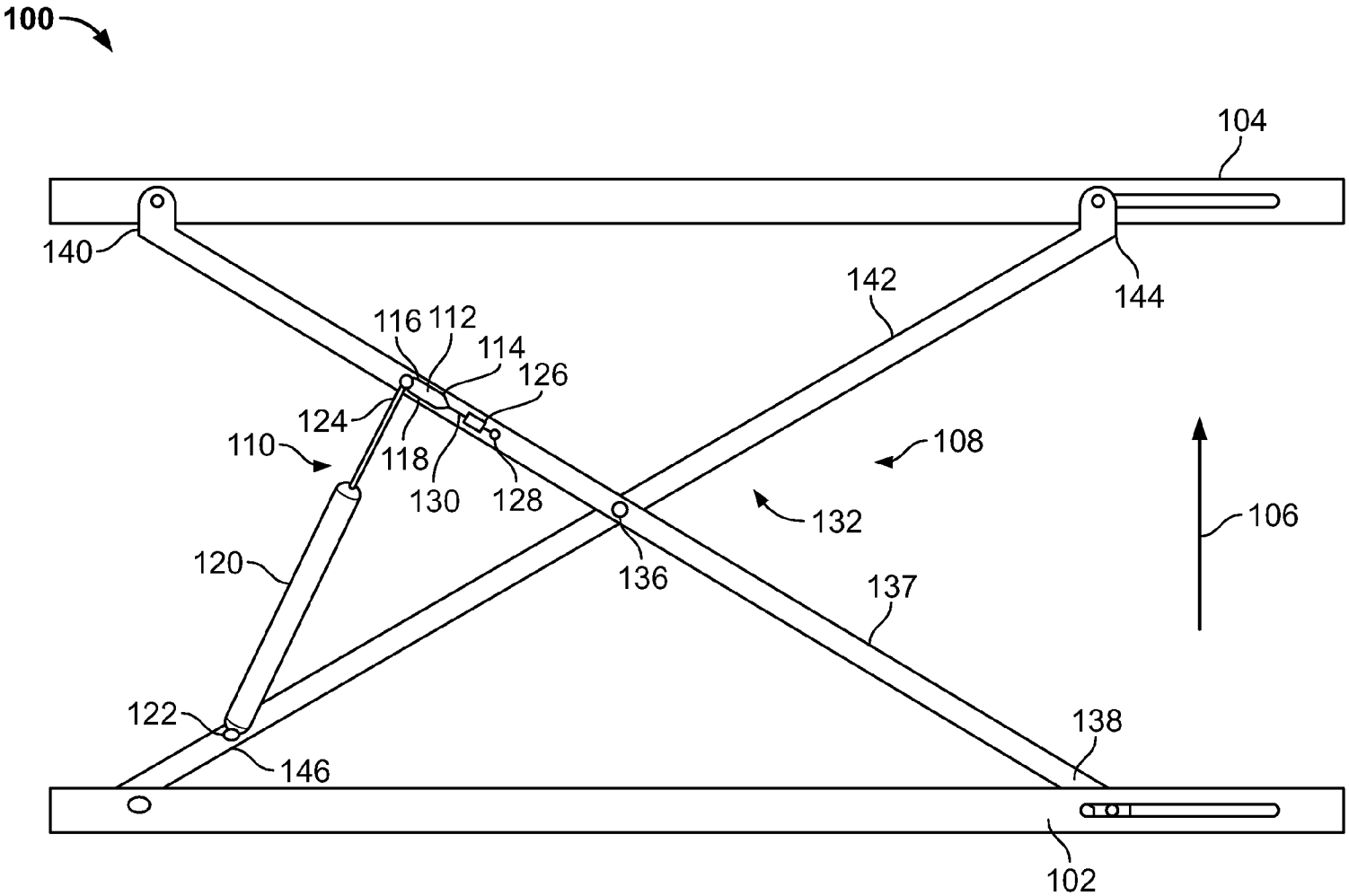
FIG. 1 is a side schematic view of an exemplary lift system in accordance with an embodiment of the present invention.

FIG. 1 is a side schematic view of an exemplary lift system 100 in accordance with an embodiment of the present invention. In the exemplary embodiment, lift system 100 includes a base 102 and a load platform 104 configured to move away from base 102 in a first direction 106. Lift system 100 includes an expandable actuator linkage 108 mechanically coupled between load platform 104 and base 102 to facilitate load platform 104 moving away from base 102. Lift system 100 also includes an actuator assembly 110 configured to provide a motive to expand actuator linkage 108. Actuator assembly 110 includes a cam 112 including a positioning lobe 114, a positioned lobe 116, and a pivot point 118 that is offset from lobes 114 and 116. Cam 112 is coupled to actuator linkage 108 at pivot point 118.

Actuator assembly 110 also includes a driving member 120, for example, but not limited to a piston and cylinder assembly or a lead screw assembly. Driving member 120 includes a first end 122 rotatably coupled to base 102 or actuator linkage 108. Driving member 120 further includes a second end 124 rotatably coupled to positioned lobe 116. Actuator assembly 110 also includes a positioning member 126 that includes a first end 128 coupled to actuator linkage 108 and a second end 130 rotatably coupled to positioning lobe 114.

In the exemplary embodiment, expandable actuator linkage 108 comprises a pair of scissor linkages 132 and 134 (only pair 132 is shown in FIG. 1) connected at a median pivot point 136. Each of scissor linkages 132 and 134 includes a first linkage 137 pivotally and slidably connected at a lower end 138 to base 102, and fixedly and pivotally connected at an upper end 140 to load platform 104. A second linkage 142 is pivotally and slidably connected at an upper end 144 to load platform 104 and fixedly and pivotally connected at a lower end 146 to base 102. Linkage 132 is connected to linkage 142 by median pivot point 136.

Figure 2:
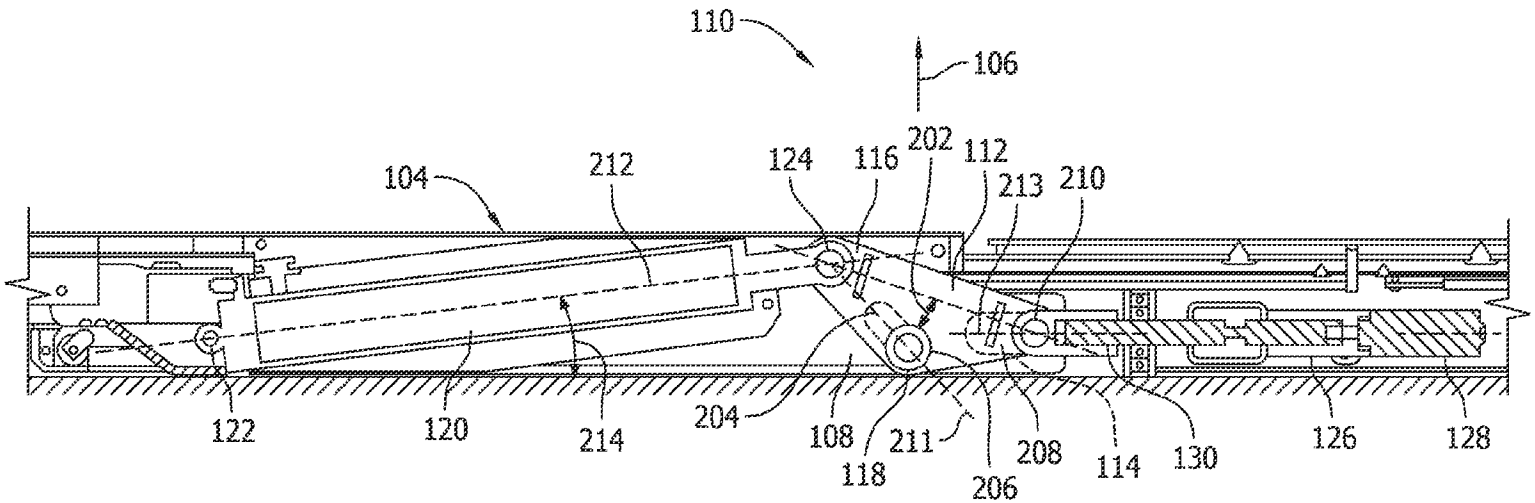
FIG. 2 is a side schematic view of the actuator assembly shown in FIG. 1 in a first starting position.

FIG. 2 is a side schematic view of actuator assembly 110 (shown in FIG. 1) in a first starting position. As used herein the first starting position includes positioning member 126 substantially fully retracted, cam 112 rotated fully counterclockwise (as viewed in FIGS. 1 and 2), and driving member 120 located on a single side of load platform 104. In the exemplary embodiment, cam 112 is substantially triangular in cross section. Cam 112 includes a positioning lobe 114, a positioned lobe 116, and a pivot point 118 that is offset from lobes 114 and 116 a distance 202. Expandable actuator linkage 108 includes a first elongate aperture 204 configured to receive a first pin 206 coupled to pivot point 118 and a second elongate aperture 208 configured to receive a second pin 210 coupled to positioning lobe 114. Positioning member 126 is coupled to positioning lobe 114 using second pin 210. First elongate aperture 204 includes a longitudinal centerline 211 and second elongate aperture 208 includes a longitudinal centerline 213. Longitudinal centerline 211 is aligned obliquely with respect to centerline 213.

In the first starting position, positioning member 126 is substantially fully retracted such that pin 210 is positioned towards the right side of second elongate aperture 208, cam 112 is rotated fully counterclockwise as viewed in FIGS. 1 and 2 such that pin 206 is positioned towards the bottom right side of first elongate aperture 204, and a longitudinal axis 212 of driving member 120 and base 102 form a first angle 214 with respect to each other. Also, in the first starting position, driving member 120 is located on a single side of load platform 104, namely the underside. Because angle 214 is relatively shallow, only a small portion of the driving force generated by driving member 120 is useful in expanding actuator linkage 108 such that load platform 104 moves in direction 106 away from base 102.

Figure 3:
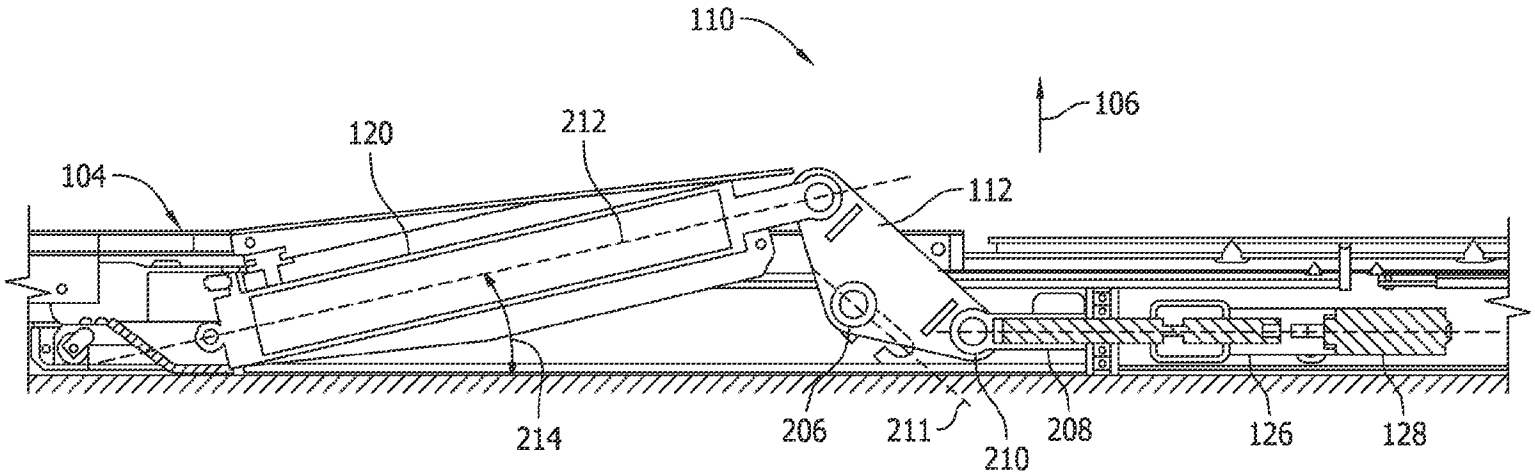
FIG. 3 is a side schematic view of the actuator assembly shown in FIGS. 1 and 2 in a second starting position.

FIG. 3 is a side schematic view of actuator assembly 110 (shown in FIGS. 1 and 2) in a second starting position. As used herein, the second starting position includes positioning member 126 substantially fully extended, cam 112 rotated fully clockwise (as viewed in FIGS. 1 and 2), and driving member 120 extended at least partially through load platform 104. In such a position, angle 214 introduces a relatively larger force component in direction 106 such that with the same driving member 120 system 100 delivers a greater force in direction 106 which translates into a capacity to raise a heavier load than when actuator assembly 110 is in the first starting position.

In operation, positioning member 126 is extended such that pin 210 and positioning lobe 114 are moved along second elongate aperture 208. Pin 206 is driven along first elongate aperture 204, which because centerline 211 is oriented obliquely with respect to centerline 213, positioned lobe 116 is rotated clockwise and away from base 102. Such rotation causes driving member 120 to rotate counterclockwise increasing angle 214 with respect to base 102. The rotation of cam 112 also extends a portion of driving member 120 and cam 112 through load platform 104 such that during extension of driving member 120, the portion of driving member 120 and cam 112 extend above load platform 104.

The multi-capacity capability of the lift system described in accordance with embodiments of the present invention permit a single lift system to adjust to the lift needs of a user while maintaining a low profile and eliminating a need to cut a pit into a concrete floor. An increased lift capability provides a user an ability to lift vehicles with a low ground clearance, and typically lower weight in a first configuration and to lift medium duty trucks and heavier commercial-style vehicles that typically have a higher ground clearance in the second configuration. In use, extending a portion of driving member 120 and cam 112 through load platform 104 does not interfere with the vehicle to be lifted because actuator assembly 110 is maintained in the first position until the vehicle is driven onto load platform 104. Actuator assembly 110 is then reposition to the second position wherein a portion of driving member 120 and cam 112 extend through load platform 104. However, because of the ground clearance of most heavier vehicles, the portion of driving member 120 and cam 112 extending through load platform 104 will not reach the undercarriage or chassis of the vehicle. In an instance of lifting a smaller vehicle, there is no need to extend the portion of driving member 120 and cam 112 through load platform 104 because system 100 has sufficient capacity in the first position to lift the relatively smaller vehicle.

Figure 4:
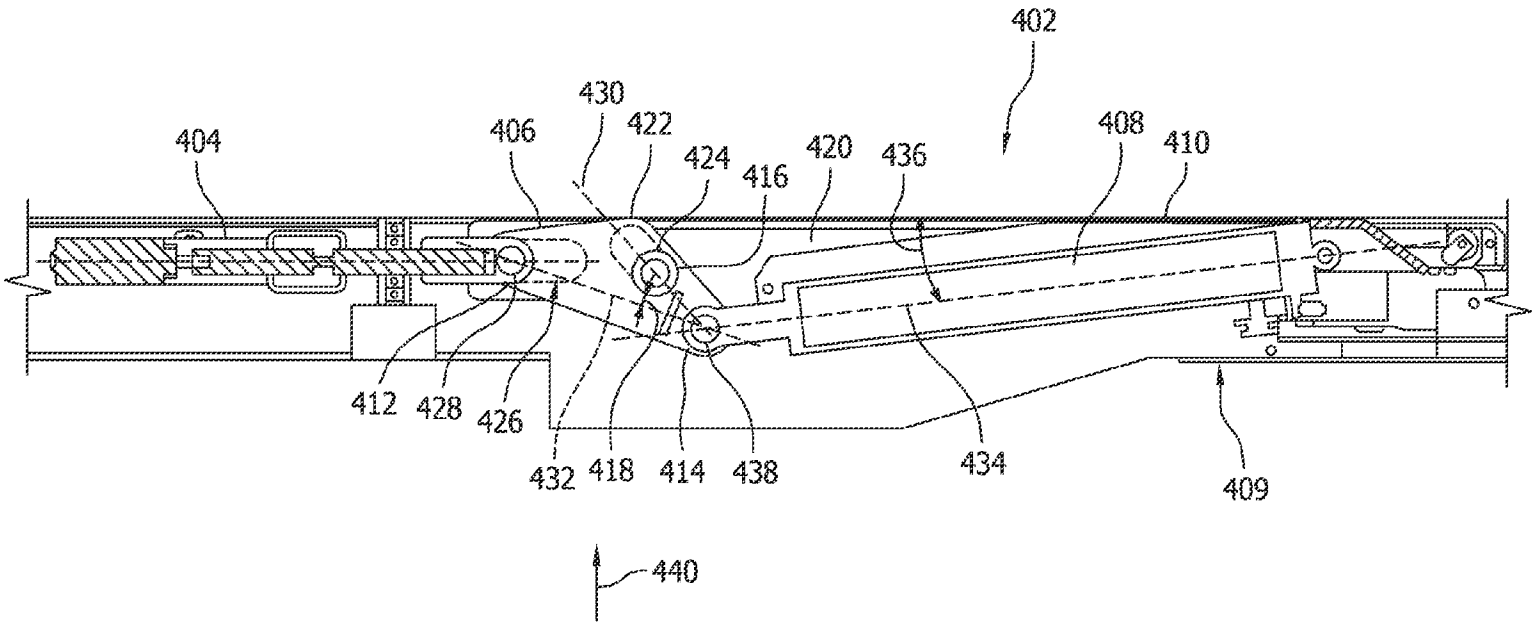
FIG. 4 is a side schematic view of an actuator assembly in accordance with an embodiment of the present invention in a first starting position.

FIG. 4 is a side schematic view of an actuator assembly 402 in accordance with an embodiment of the present invention in a first starting position. As used herein, the first starting position includes a positioning member 404 substantially fully retracted, a cam 406 rotated fully counterclockwise (as viewed in FIG. 4), and a driving member 408 located above a base 409, such as a floor of a repair shop. In the exemplary embodiment, cam 406 is substantially triangular in cross section. In an alternative embodiment, cam 406 is a straight linkage. Cam 406 includes a positioning lobe 412, a positioned lobe 414, and a pivot point 416 that is offset from lobes 412 and 414 a distance 418. An expandable actuator linkage 420 includes a first elongate aperture 422 configured to receive a first pin 424 coupled to pivot point 416 and a second elongate aperture 426 configured to receive a second pin 428 coupled to positioning lobe 412. Positioning member 404 is coupled to positioning lobe 412 using second pin 428. First elongate aperture 422 includes a longitudinal centerline 430 and second elongate aperture 426 includes a longitudinal centerline 432. In the exemplary embodiment, longitudinal centerline 430 is aligned obliquely with respect to centerline 432.

In the first starting position, positioning member 404 is substantially fully retracted such that pin 428 is positioned towards the left side of second elongate aperture 426, cam 406 is rotated fully counterclockwise as viewed in FIG. 4 such that pin 424 is positioned towards the lower right side of first elongate aperture 422, and a longitudinal axis 434 of driving member 408 and load platform 410 form a first angle 436 with respect to each other. Also, in the first starting position, driving member 408 is located on a single side of base 409, namely the upper side. Because angle 436 is relatively shallow, only a small portion of the driving force generated by driving member 408 is useful in expanding actuator linkage 420 such that a first end 438 of driving member 408 moves in a direction 440 away from load platform 410.

A second starting position includes positioning member 404 substantially fully extended, cam 406 rotated substantially fully clockwise, and driving member 408 extended at least partially downwardly through or past base 409 below floor level. In such a position, angle 436 introduces a relatively larger force component in direction 440 such that with the same driving member 408, system 100 delivers a greater force in direction 440 which translates into a capacity to raise a heavier load than when actuator assembly 402 is in the first starting position.

In operation, positioning member 404 is extended such that pin 428 and positioning lobe 412 are moved along second elongate aperture 426. Pin 424 is driven along first elongate aperture 422, which because centerline 422 is oriented obliquely with respect to centerline 432, positioned lobe 116 is rotated clockwise and away from load platform 410. Such rotation causes driving member 408 to rotate counterclockwise increasing angle 436 with respect to load platform 410. The rotation of cam 406 also extends a portion of driving member 408 and cam 406 through or past base 409 such that during extension of driving member 408, the portion of driving member 408 and cam 406 extend below base 409.

Figure 5:
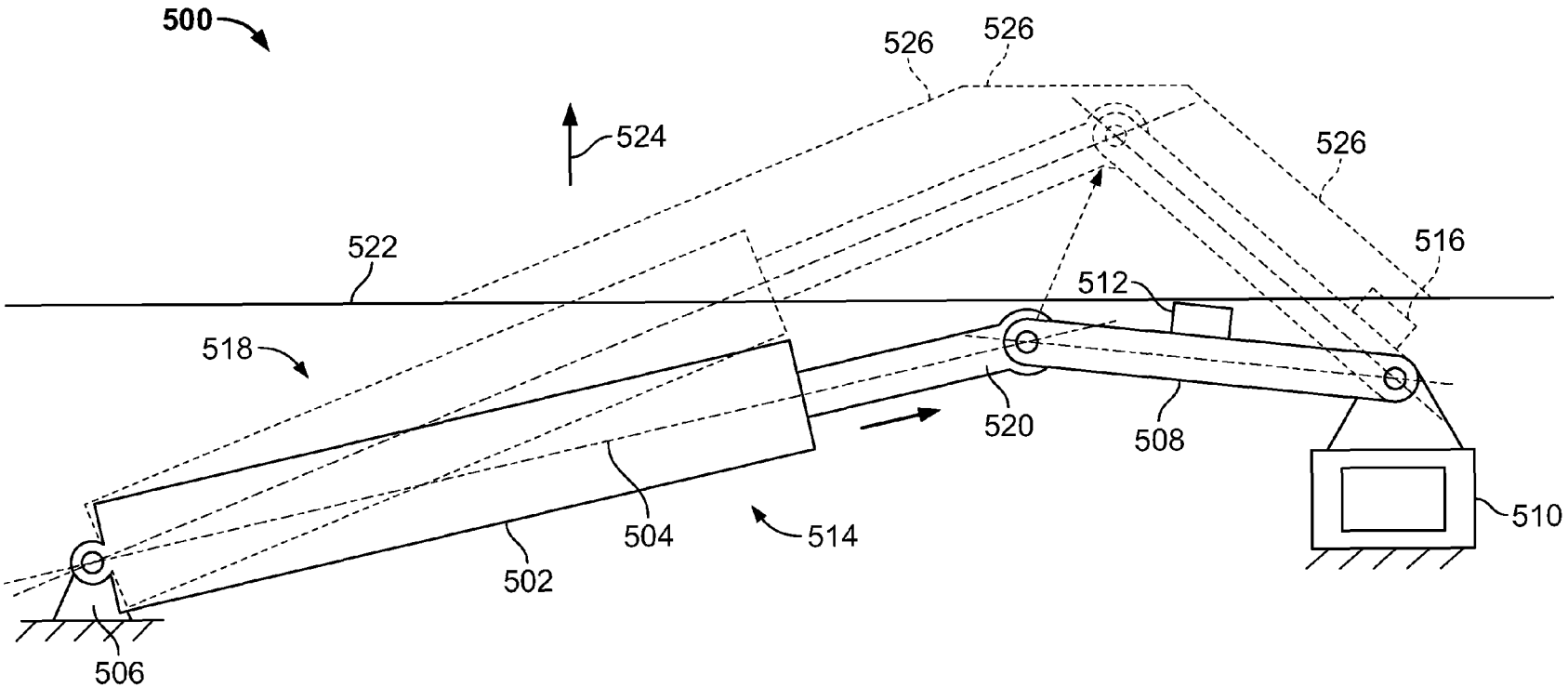
FIG. 5 is a side elevation view of a multi-capacity lift system actuating assembly in accordance with another embodiment of the present invention.

FIG. 5 is a side elevation view of a multi-capacity lift system actuating assembly 500 in accordance with another embodiment of the present invention. Actuating assembly 500 includes a driving member 502 having a longitudinal axis 504 coupled between an anchor 506 and a positioning linkage 508, which is further coupled to an expandable linkage assembly 510. A first travel stop 512 maintains driving member 502 in a first starting position 514. A second travel stop 516 maintains driving member 502 in a second starting position 518 (shown in dotted outline in FIG. 5). In first starting position 514, a distal end 520 of driving member 502 remains on a single side of a load platform 522.

During operation, a low or high capacity lift is selected by a user. Alternatively, the lift capacity is automatically selected based on a sensed parameter of a load (not shown) on load platform 522, for example, but not limited to a weight of the load, a total height of the load, a gap distance between load platform 522 and an underside of the load, and a length or wheelbase of the load. If the lower lift capacity is selected, first travel stop 512 is in a position to prevent rotation of positioning linkage 508. Driving member 502 extending bears against first travel stop 512 and a first driving force is transmitted though positioning linkage 508 to expandable linkage assembly 510 to expand linkage assembly 510, which in turn moves load platform 522 in a direction 524 at a first lift capacity. Alternatively, if the higher lift capacity is selected, first travel stop 512 is in a position to permit rotation of positioning linkage 508 until it engages second travel stop 516. Driving member 502 extending rotates positioning linkage 508 from first starting position 514 to second starting position 518. The rotation of positioning linkage 508 permits driving member 502 to rotate to second starting position 518, where a portion of driving member 502 extends above load platform 522. In an alternative embodiment, none of driving member 502 extends above load platform 522. In the exemplary embodiment, one or more movable plates 526 extend above load platform 522 to cover an aperture through which driving member 502 extends. In an alternative embodiment, driving member 502 extends past load platform 522 without passing through load platform 522 such that plates 526 are not necessary and are not used. After a predetermined amount of extension of driving member 502, positioning linkage 508 bears against second travel stop 516 and a second driving force is transmitted though positioning linkage 508 to expandable linkage assembly 510 to expand linkage assembly 510, which in turn moves load platform 522 in a direction 524 at a second lift capacity. Because of the change in geometry of expandable linkage assembly 510 and actuator assembly 500, second lift capacity is greater than first lift capacity permitting heavier loads, such as trucks to be lifted using a lift system having the same starting height as when the first capacity lift is selected. Because heavier loads are generally associated with a larger ground clearance, driving member 502 extending above load platform during a lift will not engage the underside of the truck.

Figure 6A:
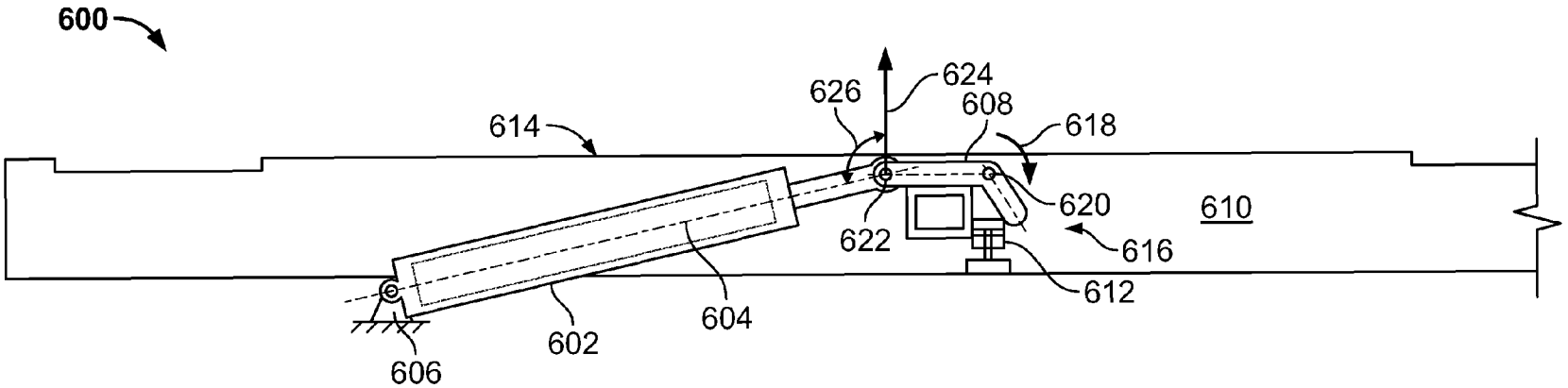
FIGS. 6A and 6B are side elevation views of a multi-capacity lift system actuating assembly in accordance with another embodiment of the present invention.
Figure 6B:
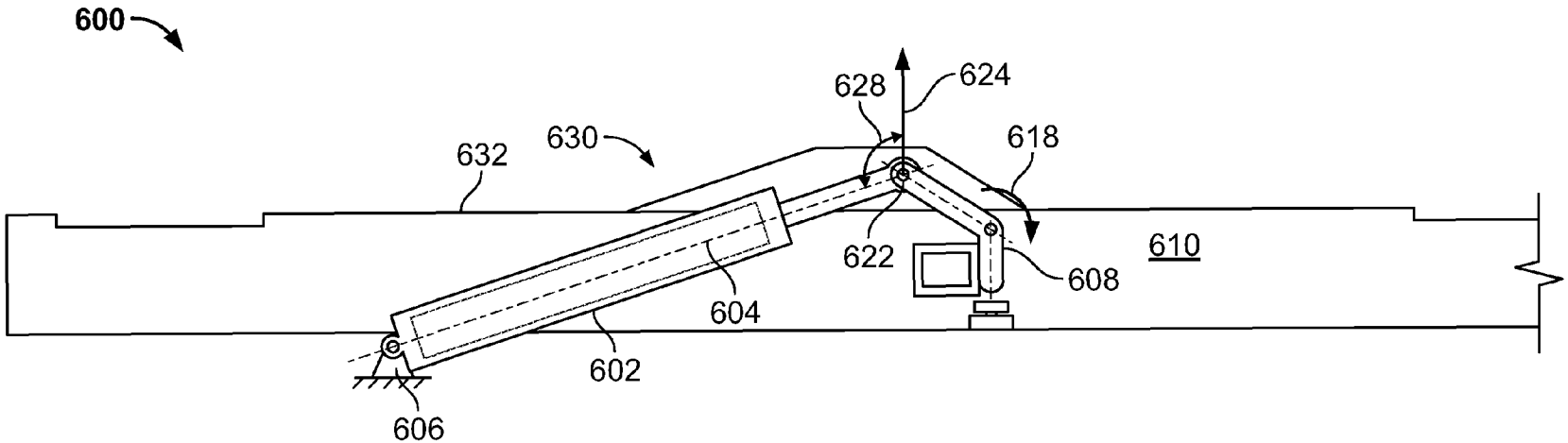

FIGS. 6A and 6B are side elevation views of a multi-capacity lift system actuating assembly 600 in accordance with another embodiment of the present invention. Actuating assembly 600 includes a driving member 602 having a longitudinal axis 604 coupled between an anchor 606 and a positioning linkage 608, which is further coupled to an expandable linkage assembly 610. A travel stop 612 in a first position 616 maintains positioning linkage 608 in a locking position that prevents positioning linkage from rotating in a clockwise direction 618 about pin 620.

During operation in first position 614, driving member 602 is extended such that a distal end 622 bears against positioning linkage 608 transferring the force generated by the extending driving member 602 to expandable linkage assembly 610. The force imparted to expandable linkage assembly tends to expand the linkage assembly 610 in a direction 624 at a first relatively low lifting capacity. The lifting capacity is related to an angle 626 between driving member 602 and direction 624. In first starting position 614 a relatively smaller portion of the force generated by driving member 602 is applied in direction 624.

Travel stop 612 is movable to a second position such that it does not prevent rotation of positioning linkage 608 to a second position shown in FIG. 6B. As driving member 602 extends, positioning linkage 608 rotates in direction 618 to a fully rotated position. In alternative embodiments, intermediate stops may be used to provided additional stop locations. With positioning linkage 608 in the fully rotated position, further extension of driving member 602 begins applying a force to distal end 622, which bears against positioning linkage 608 transferring the force generated by the extending driving member 602 to expandable linkage assembly 610. The force imparted to expandable linkage assembly tends to expand the linkage assembly 610 in a direction 624 at a second relatively high lifting capacity. The lifting capacity is related to an angle 628 between driving member 602 and direction 624. In second starting position 630, a relatively larger portion of the force generated by driving member 602 is applied in direction 624. In the exemplary embodiment, in second starting position 630, a portion of driving member extends past or through load platform 632 to permit a high lift capacity while maintaining a relatively low starting height for load platform 632 during load lifting.

The above-described methods and systems of lifting a load are cost-effective and highly reliable. The methods and systems facilitate operating a lift system capable of accommodating the dimensions of smaller vehicles having a lighter weight while being capable of lifting relatively larger and heavier loads where physical dimensions are less of a concern in a cost-effective and reliable manner.

While embodiments of the disclosure have been described in terms of various specific embodiments, those skilled in the art will recognize that the embodiments of the disclosure can be practiced with modification within the spirit and scope of the claims.

What is claimed is:

1. A multi-capacity vehicle lift system comprising:

a load platform having a vehicle support surface defining a plane;

an expandable linkage assembly mechanically coupled to said load platform to facilitate raising said load platform above a base surface, said linkage expandable between a fully collapsed position and an expanded position wherein the load platform is raised above said base surface; and an actuator assembly coupled to said expandable linkage, said actuator assembly having an adjustable length driving member configured to transition between a retracted length and an extended length, said actuator assembly positionable at a plurality of different starting angles relative to said base surface while the expandable linkage is in the fully collapsed position and said driving member is at said retracted length, wherein each of the different starting angles enables said driving member to apply a different vertical force component to said expandable linkage during extension from said retracted length, and wherein each of said different starting angles is associated with a respectively different lift capacity for elevating said load platform.

2. A system in accordance with claim 1 wherein said expandable linkage assembly comprises a pair of scissor linkages each connected at a median pivot point or a pair of parallelogram lift linkages.

3. A system in accordance with claim 1 wherein said actuator assembly further comprises:

a cam comprising a positioning lobe, a positioned lobe, and a pivot point offset from said lobes, said cam coupled to said expandable linkage assembly at said pivot point;

a positioning member comprising a first end coupled to said expandable linkage assembly and a second end rotatably coupled to the positioning lobe of said cam, said positioning member configured to selectively alter an orientation of said cam relative to said expandable linkage assembly while the expandable linkage is in the fully collapsed position and said driving member is at said retracted length;

wherein said driving member includes a first end rotatably coupled to said expandable linkage assembly and a second end rotatably coupled to the positioned lobe of said cam, a distance between said first and second ends defining said adjustable length of said driving member; and wherein said starting angle of said actuator assembly corresponds to said orientation of said cam relative to said expandable linkage assembly.

4. A system in accordance with claim 3 wherein in a first position of said cam and said positioning member, said driving member is fully disposed on one side of said plane of said load platform vehicle support surface and wherein in a second position of said cam and said positioning member, said driving member extends at least partially through said plane.

5. A system in accordance with claim 3 wherein in a first position of said cam and said positioning member, said driving member is fully disposed above said base surface, and wherein in a second position of said cam and said positioning member, said driving member extends at least partially below said base surface.

6. A system in accordance with claim 1, wherein the expandable linkage assembly is supported on said base surface, and in one of the plurality of different start angles at least a portion of the actuator assembly extends below the base surface.

7. A multi-capacity lift system comprising:

a load platform having a top surface;

an expandable linkage assembly mechanically coupled to said load platform to facilitate raising said load platform from a fully collapsed position; and an actuator assembly comprising an extendable driving member positionable to engage and lift the linkage assembly from the fully collapsed position with a first lift capacity in a first position and retracted configuration at a first angle with respect to the load platform, and with a second lift capacity in a second position and said retracted configuration at a second angle with respect to the load platform, wherein the second lift capacity is greater than the first lift capacity;

wherein said actuator assembly remains below a plane of said top surface in the first position and wherein said actuator extends at least partially above the plane of said top surface in the second position.

8. A system in accordance with claim 7 wherein said actuator assembly further includes a triangular cam coupled between said driving member and said expandable linkage assembly, said triangular cam having a pivot point adjacent one vertex, a positioning lobe adjacent a second vertex, and a positioned lobe adjacent a third vertex.

9. A system in accordance with claim 8 wherein said expandable linkage assembly comprises a first elongate aperture configured to receive a first pin coupled to said pivot point and a second elongate aperture configured to receive a second pin coupled to said positioning lobe.

10. A system in accordance with claim 7 further comprising a positioning member comprising a first end coupled to said expandable linkage assembly and a second end rotatably coupled to the actuator assembly, said positioning member configured to switch the position of the actuator between the first position and the second position.

11. A system in accordance with claim 7 wherein said expandable linkage assembly comprises a pair of scissor linkages connected at a median pivot point or a pair of parallelogram linkages.

12. A method of altering a lift capacity of a vehicle lift device wherein the vehicle lift device includes an expandable actuator linkage coupled to a load platform to elevate a vehicle support surface of the load platform relative to a base and an actuator assembly coupled between the expandable actuator linkage and said base, the actuator assembly configured with an extendable driving member to apply a vertical force to the expandable actuator linkage while the expandable actuator linkage is in a fully collapsed position, said method comprising:

altering said vertical force to be applied to said expandable actuator linkage in said fully collapsed position by selecting a first starting position from a plurality of available starting positions for the actuator extendable driving member in a retracted configuration, thereby altering a lift capacity for raising a load on the load platform with the expandable actuator linkage; and positioning the actuator extendable driving member in the selected starting position while the expandable actuator linkage is in the fully collapsed position and the extendable driving member is in said retracted configuration.

13. A method in accordance with claim 12 wherein said step of positioning the actuator extendable driving member in the selected starting position comprises positioning the actuator extendable driving member such that at least a portion of the actuator extends through a plane of the load platform while the expandable actuator linkage is in the fully collapsed position.

14. A method in accordance with claim 12, wherein said step of positioning the actuator extendable driving member in the selected starting position comprises positioning the actuator extendable driving member such that at least a portion of the actuator extends below a surface of the base while the expandable actuator linkage is in the fully collapsed position.

15. A method in accordance with claim 12 wherein said step of positioning the actuator extendable driving member in the selected starting position includes setting said extendable driving member at a selected angle relative to said vertical force.

16. A lifting device for a vehicle, the lifting device comprising:

first and second scissor units, each of which includes a base member disposed on a base surface and a load platform defining a vehicle support surface, said first and second scissor units adjustable between a collapsed position and a raised position in which said load platform is elevated above said base surface from said collapsed position; and for each scissor unit, a respective driving member pivotally attached at one end to a lever of the respective scissor unit, said driving member configured to transition between a retracted state and an extended state, and further configured to be translated, while in said retracted state, between a first starting position providing a first vertical force component to elevate said load platform from the initial collapsed position, and a second starting position providing a second vertical force component which is different from the first vertical force component to elevate said load platform from the initial collapsed position, the first and second starting positions corresponding to distinct lift capacities for the lifting device.

17. A lifting device in accordance with claim 16 wherein said driving member defines a longitudinal centerline between said retracted state and said extended state;

wherein, in the first starting position, the longitudinal centerline is oriented at a first angle with respect to said base surface supporting the base members;

wherein in the second starting position the longitudinal centerline is oriented at a second angle with respect to the base surface; and wherein the first angle is less than the second angle.

18. A lifting device in accordance with claim 16 wherein in the first starting position said driving member is positioned below said vehicle support surface; and wherein in the second starting position at least a portion of said driving member extends vertically above said vehicle support surface.

* * * * *